US007668500B2

(12) United States Patent
Kawashima

(10) Patent No.: US 7,668,500 B2
(45) Date of Patent: Feb. 23, 2010

(54) IMAGE FORMING DEVICE

(75) Inventor: Tetsuro Kawashima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 144 days.

(21) Appl. No.: 11/876,319

(22) Filed: Oct. 22, 2007

(65) Prior Publication Data

US 2008/0044210 A1 Feb. 21, 2008

Related U.S. Application Data

(63) Continuation of application No. 10/905,291, filed on Dec. 23, 2004, now Pat. No. 7,302,223.

(30) Foreign Application Priority Data

Dec. 26, 2003 (JP) ..... 2003-433556

(51) Int. Cl.
*G03G 15/00* (2006.01)

(52) U.S. Cl. ..... 399/392; 399/405; 400/693; 271/171

(58) Field of Classification Search ..... 400/691, 400/692, 693; 399/367, 369, 392, 393; 271/171
See application file for complete search history.

(56) References Cited

U.S. PATENT DOCUMENTS 7,099,618 B2 * 8/2006 Iwago et al. ..... 399/367

FOREIGN PATENT DOCUMENTS

| | | | |
|---|---|---|---|
| JP | H07-005632 | A | 1/1995 |
| JP | H08-185107 | A | 7/1996 |
| JP | H09-188443 | A | 7/1997 |
| JP | 3092791 | U | 1/2003 |
| JP | 2003-201046 | A | 7/2003 |

* cited by examiner

*Primary Examiner*—Ren Yan
(74) *Attorney, Agent, or Firm*—Global IP Counselors, LLP

(57) ABSTRACT

An image forming device includes an image forming device body having an image forming unit in the interior thereof, and at least one paper tray attached to the image forming device on which paper is to be mounted. The paper tray includes a paper mounting unit having a paper mounting surface on which paper is to be mounted, and at least one movable auxiliary mounting unit. The auxiliary mounting unit is supported by the paper mounting unit, and includes an auxiliary mounting surface that is deployed from the paper mounting unit and which serves to extend the mounting surface. The brightnesses of the mounting surface and the auxiliary mounting surface of the paper tray are lower than the brightness of the paper to be mounted on each mounting surface, and the brightness of at least a portion of the auxiliary mounting surface is higher than the brightness of the mounting surface.

3 Claims, 9 Drawing Sheets

Results of recognition experiment

| Experiment number | Brightness | | | ability to recognize the auxiliary mounting unit deployment state | | ability to recognize presence or absence of discharged paper | | ability to recognize continuous paper discharge | |
|---|---|---|---|---|---|---|---|---|---|
| | Mounting surface | Auxiliary mounting surface | Side surface of device body | Subject A | Subject B | Subject A | Subject B | Subject A | Subject B |
| 1 | 9 | 9 | 9 | △ | × | × | × | × | × |
| 2 | 7 | 7 | 7 | × | × | △ | △ | △ | △ |
| 3 | 5 | 5 | 5 | × | × | ○ | △ | ○ | △ |
| 4 | 3 | 3 | 3 | × | × | ○ | ○ | ○ | ○ |
| 5 | 9 | 7 | 7 | × | × | × | × | △ | × |
| 6 | 3 | 7 | 3 | ○ | ○ | ○ | ○ | ○ | ○ |
| 7 | 3 | 7 | 7 | ○ | ○ | ○ | ○ | × | × |
| 8 | 5 | 7 | 5 | ○ | △ | ○ | △ | ○ | △ |
| 9 | 5 | 6 | 5 | △ | △ | ○ | △ | ○ | △ |
| 10 | 7 | 9 | 7 | △ | △ | △ | △ | △ | △ |

*Fig. 9*

IMAGE FORMING DEVICE

This application is a continuation application of U.S. patent application Ser. No. 10/905,291 filed on Dec. 23, 2004. The entire disclosure of U.S. patent application Ser. No. 10/905,291 is hereby incorporated herein by reference.

This application claims priority to Japanese Patent Application No. 2003-433556. The entire disclosure of Japanese Patent Application No. 2003-433556 is hereby incorporated herein by reference.

BACKGROUND OF THE INVENTION

1. Field of the Invention

The present invention relates to an image forming device such as a facsimile device, a printer, or the like, and in particular to an image forming device comprised of a paper tray having a movable auxiliary mounting unit that can be deployed from a paper mounting unit.

2. Background Information

Generally speaking, image forming devices such as copying machines, facsimile devices, printers and the like are provided with a paper supply cassette that stores paper for recording images thereon, and a manual paper supply tray that allows a user to supply paper of a different orientation or size than that stored in the paper supply cassette. One type of prior art manual paper supply tray for an image forming device includes a paper mounting unit arranged so as to be extendable and foldable with respect to a side surface of the image forming device, and an auxiliary mounting unit that is arranged so that it can slide out from the paper mounting unit (see, for example, FIGS. 1-3 of Japanese Patent Application Publication No. H09-188443). In addition, the prior art also discloses a paper discharge tray to which printed sheets are discharged, and is arranged so as to extend from a side surface of the image forming device (see, for example, FIGS. 1-3 of Japanese Patent Application Publication No. H09-188443).

Most of these types of image forming devices have an exterior color that is a shade of white (which includes white, beige, ivory, or the like), and the color of the manual paper supply tray and the paper discharge tray is identical to or a similar shade of the exterior color. In addition, the paper mounting unit and the auxiliary mounting unit that form the manual paper supply tray or the paper discharge tray have the same identical color, and have a color that is identical to or a similar shade of the exterior color.

The white shade of color of these types of image forming devices is useful to brighten the interior of an office. However, if the color of the manual paper supply tray and the discharge tray are the same color as the exterior of the image forming device, it will be difficult for a user located some distance away from the image forming device to confirm whether or not there is paper remaining in the manual paper supply tray, or confirm that paper is being discharged to the paper discharge tray, i.e., whether or not the image forming device is operating. In particular, because the lighting in office space has in recent years been set to a slightly dark level, and because image forming devices are often placed in slightly dark, non-central locations, it is often difficult to confirm the presence of paper in the manual paper supply tray and the paper discharge tray. Furthermore, image forming devices are now being designed for quiet operation, and thus it is often difficult for one to determine whether or not the image forming device is operating by means of operational sounds. Thus, a user located some distance away from the image forming device must walk to a point near the image forming device in order to confirm the operational state of the image forming device.

On the other hand, if the color of the exterior of the image forming device is a shade of black (such as black, gray, or the like) in order to make it easier to distinguish it from white paper, it will be easier to confirm whether or not there is paper remaining in the manual paper supply tray or whether or not paper is being discharged to the paper discharge tray.

However, a manual paper supply tray or a paper discharge tray foldably arranged on a side surface of an image forming device will be used in a state in which it extends out from the device, and an auxiliary mounting unit thereof may also be extended therefrom. Thus, if an image forming device having an exterior that is a shade of black is placed in a slightly dark location, and the manual paper supply tray or the paper discharge tray extends out from a side surface of the device, there is a possibility that a person passing by this location may not notice that one or both of these trays are extended, and thus collide with and damage them.

In addition, although the manual paper supply tray and the paper discharge tray include a paper mounting unit arranged so as to be extendable and foldable with respect to a side surface of the image forming device, and an auxiliary mounting unit that is arranged so that it can slide out from the paper mounting unit, when the auxiliary mounting unit is to be pulled out from the paper mounting unit, it will be difficult for one to immediately recognize which portion one needs to grasp and pull out because the paper mounting unit and the auxiliary mounting unit are both the same color.

In view of the above, there exists a need for a method of producing an image forming device which overcomes the above mentioned problems in the prior art. This invention addresses this need in the prior art as well as other needs, which will become apparent to those skilled in the art from this disclosure.

SUMMARY OF THE INVENTION

It is an object of the present invention to provide an image forming device that allows a user located some distance away from the image forming device to easily confirm the presence of paper in a paper tray thereof and the operational state of the device.

Another object of the present invention is to provide an image forming device that improves the visibility of a paper tray thereon so as to prevent one from colliding therewith, and which allows an auxiliary mounting unit of the paper tray to be easily deployed, even when the image forming device is placed in a slightly dark location.

An image forming device according to one aspect of the present invention includes an image forming device body having an image forming unit in the interior thereof, and at least one paper tray attached to the image forming device on which paper is to be mounted. The paper tray includes a paper mounting unit having a paper mounting surface on which paper is to be mounted, and at least one movable auxiliary mounting unit. The auxiliary mounting unit is supported by the paper mounting unit, and includes an auxiliary mounting surface that is deployed from the paper mounting unit and which serves to extend the mounting surface. The brightnesses of the mounting surface and the auxiliary mounting surface of the paper tray are lower than the brightness of the paper to be mounted on each mounting surface, and the brightness of at least a portion of the auxiliary mounting surface is higher than the brightness of the mounting surface.

With this device, a user located some distance away from the image forming device can easily confirm whether or not there is paper remaining on the paper tray, whether or not paper is being discharged and thus whether or not the device is operating, and the like. In addition, even if the image forming device is placed in a slightly dark location, the visibility of the paper tray can be improved so that people will not collide therewith.

Here, when the auxiliary mounting surface is in the deployed state, the portions of the auxiliary mounting surface of the auxiliary mounting unit having a higher brightness than that of the mounting surface of the paper mounting unit preferably includes at least the edge portion of the auxiliary mounting surface that is farthest away from the mounting surface of the paper mounting unit.

The brightness settings of the paper tray are preferably such that the difference between the brightness of the paper and the brightness of the mounting surface of the paper mounting unit as defined by JIS Z8721 is three or greater (more preferably 5 or greater), and the difference between the brightness of the portions of the auxiliary mounting surface of the auxiliary mounting unit having the highest brightness and the brightness of the mounting surface of the paper mounting unit as defined by JIS Z8721 is 2 or greater (and more preferably 3 or greater). In addition, because the brightness of standard paper is 9 to 9.5, these settings mean that the brightness of the paper mounting surface of the paper mounting unit is set to be 6 or less (preferably 4 or less) as defined by JIS Z8721, and the difference between the brightness of the portions of the auxiliary mounting surface of the auxiliary mounting unit having the highest brightness and the brightness of the mounting surface of the paper mounting unit as defined by JIS Z8721 is 2 or greater (preferably 3 or greater). Note that the brightness values of the present invention are values based upon the three color attributes display method defined in JIS Z8721.

Note also although "brightness" is used in the specification and claims of the present invention to define the color settings of each component, the technical scope of the present invention is not to be narrowly interpreted by this definition. The color settings may be represented in a variety of other ways instead of brightness. For example, when the numerical value of "brightness" is represented by "reflection density", the aforementioned conditions will generally be as follows. In other words, the reflection density settings of the paper tray are preferably such that the difference between the reflection density of the paper and the reflection density of the mounting surface of the paper mounting unit is 0.4 or greater (more preferably 0.8 or greater), and the difference between the reflection density of the mounting surface of the paper mounting unit and the reflection density of the auxiliary mounting surface of the auxiliary mounting unit is 0.4 or greater (and more preferably 0.6 or greater). In addition, because the reflection density of standard paper is about 0.1, these settings mean that the reflection density of the mounting surface of the paper mounting unit is set to be 0.5 or less (preferably 0.9 or less), and the difference between the reflection density of the mounting surface of the paper mounting unit and the reflection density of the auxiliary mounting surface of the auxiliary mounting unit is 0.4 or greater (preferably 0.6 or greater).

In another aspect of the present invention, the auxiliary mounting unit can be stored in the paper mounting unit, at least one portion of the auxiliary mounting unit is visible from the paper mounting unit when in the stored state, and the brightness of the visible portion of the auxiliary mounting unit is higher than the brightness of the paper mounting unit.

In this aspect of the present invention, the brightness of the visible portion of the auxiliary mounting unit when stored is higher than the brightness of the paper mounting unit around the periphery thereof and easily recognizable. Thus, a user will easily recognize the portion which must be grasped in order to deploy the auxiliary mounting unit from the paper mounting unit, and thereby make it possible for the paper tray to be easily deployed.

In yet another aspect of the present invention, the paper tray can be deployed from and stored in the side surface of the image forming device body, and the brightness of the portion of the side surface around the periphery of the paper tray is lower than the brightness of the paper.

In this aspect of the present invention, because the thickness of the paper mounted on the paper tray can be easily confirmed from the sides thereof, the presence or absence as well as the amount of paper mounted on the paper tray can be easily confirmed by a user even if they are located some distance away from the image forming device.

In yet another aspect of the present invention, the paper tray includes movable guide members, and the brightness of the guide members is higher than the brightness of the paper mounting unit.

In this aspect of the present invention, because the brightness of the guide members (the movable portions) is higher than the brightness of the paper mounting unit around the peripheries thereof, and because a regularity can be provided in which both the movable portions, as well as the portions of the auxiliary mounting unit having a brightness higher than the brightness of the mounting surface of the paper mounting unit, will have a high degree of brightness, a user will easily recognize the portion he or she must grasp when the guide members are to be operated or the paper tray deployed, and thereby allow the user to easily operate and deploy the same.

In yet another aspect of the present invention, the auxiliary mounting unit can be stored in the paper mounting unit, and is a first auxiliary mounting unit that is deployable by pulling out along the mounting surface of the paper mounting unit.

In yet another aspect of the present invention, the first auxiliary mounting unit has a first auxiliary mounting surface, and the auxiliary mounting unit further includes a second auxiliary mounting unit that is supported by the first auxiliary mounting unit and which can be deployed by pivoting around a pivot shaft horizontally arranged near a edge portion of the first auxiliary mounting unit. In addition, the brightness of the second auxiliary mounting surface is higher than the brightnesses of the mounting surface and the first auxiliary mounting surface.

In yet another aspect of the present invention, the auxiliary mounting unit includes an auxiliary mounting surface that can be deployed by rotationally sliding the same around a rotation shaft that is approximately perpendicular to the mounting surface of the paper mounting unit.

In this aspect of the present invention, a user can easily deploy the auxiliary mounting unit by simply grasping the auxiliary mounting surface of the auxiliary mounting unit and rotationally sliding the same.

In yet another aspect of the present invention, the first auxiliary mounting unit has a first auxiliary mounting surface, and the auxiliary mounting unit further includes a second auxiliary mounting unit that is supported by the first auxiliary mounting unit. The second auxiliary mounting unit has a second auxiliary mounting surface that can be deployed from the first auxiliary mounting unit by rotatively sliding around a rotation shaft that is approximately perpendicular to the first auxiliary mounting surface. The brightness of the second auxiliary mounting surface is higher than the brightnesses of the mounting surface and the first auxiliary mounting surface.

In yet another aspect of the present invention, the first auxiliary mounting unit has a first auxiliary mounting surface, and the auxiliary mounting unit further includes a second auxiliary mounting unit that is supported by the first auxiliary mounting unit. The second auxiliary mounting unit has a second auxiliary mounting surface that can be pulled out along the first auxiliary mounting surface and deployed. The brightness of the second auxiliary mounting surface is higher than the brightnesses of the mounting surface and the first auxiliary mounting surface.

In yet another aspect of the present invention, the difference between the brightness of the paper and the brightness of the mounting surface of the paper mounting unit is 3 or greater as defined by JIS Z8721, and the difference between the brightness of the portion of the auxiliary mounting surface of the auxiliary mounting unit having the highest brightness and the brightness of the mounting surface of the paper mounting unit is 2 or greater as defined by JIS Z8721.

In yet another aspect of the present invention, the brightness of the mounting surface of the paper mounting unit is 6 or less as defined by JIS Z8721, and the difference between the brightness of the portion of the auxiliary mounting surface of the auxiliary mounting unit having the highest brightness and the brightness of the mounting surface of the paper mounting unit is 2 or greater as defined by JIS Z8721.

In yet another aspect of the present invention, the paper tray is a manual paper supply tray.

In yet another aspect of the present invention, the paper tray is a paper discharge tray.

In yet another aspect of the present invention, the image forming device further includes an original document transport device having an original document mounting tray on which one or more original documents are to be mounted prior to being read by the image forming unit, and an original document discharge tray on which one or more original documents are to be mounted after being read by the image forming unit. The original document discharge tray is the paper tray of the present invention.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 9 is a table showing the results of an experiment conducted in order to confirm what type of results would be obtained with various brightness settings of the image forming device according to the present invention.

DETAILED DESCRIPTION OF THE PREFERRED EMBODIMENTS

Embodiments of the present invention will be described below with reference to the figures.

First Embodiment

Figure 1:
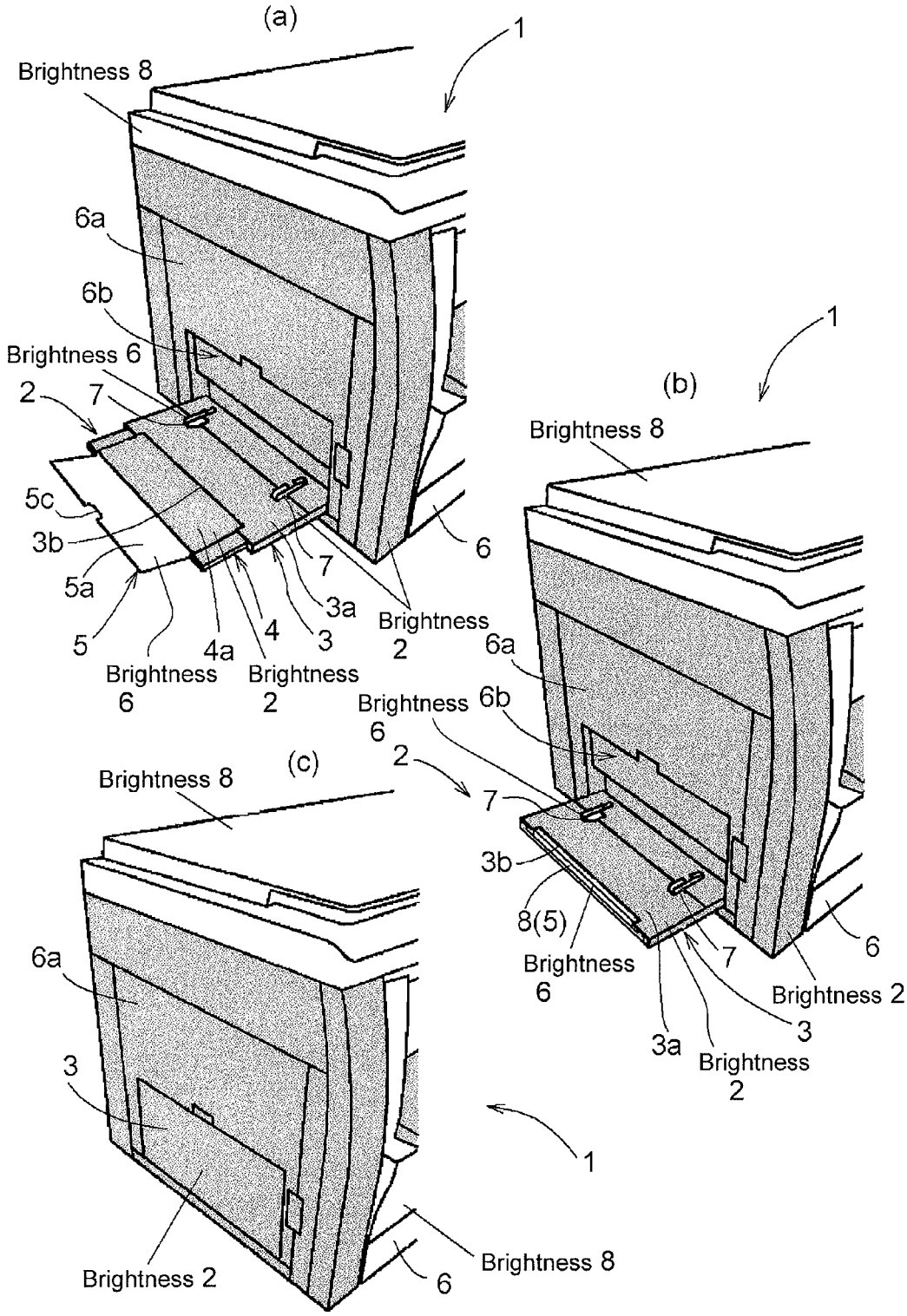
FIG. 1 shows various oblique views of a manual paper supply tray of an image forming device according to a first embodiment of the present invention.
Figure 2:
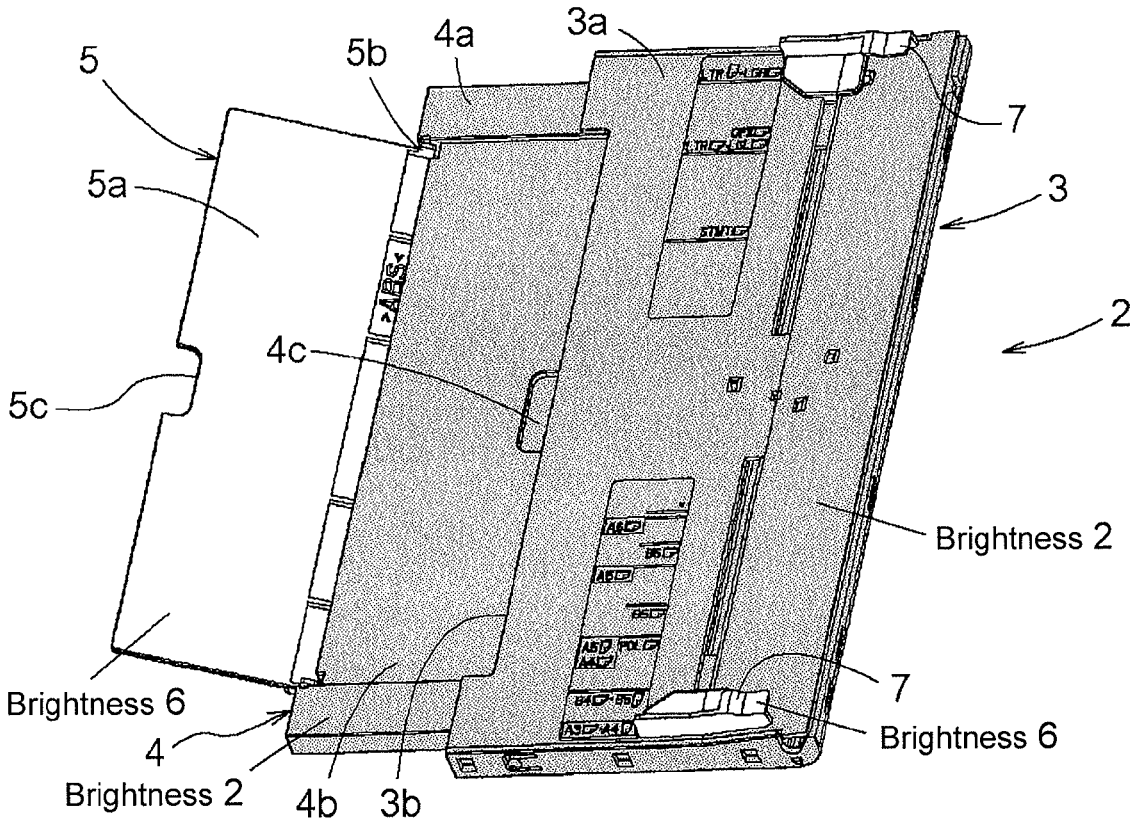
FIG. 2 shows an oblique view of the manual paper supply tray according to the first embodiment of the present invention.

FIG. 1 shows a side portion of an image forming device 1 according to a first embodiment of the present invention, with FIG. 1(*a*) showing a manual paper supply tray 2 in a fully deployed state, FIG. 1(*b*) showing the manual paper supply tray 2 deployed at a first step in which only a paper mounting unit 3 is in the deployed state, and FIG. 1(*c*) showing the manual paper supply tray 2 in the stored state. FIG. 2 is an oblique view of the configuration of the manual paper supply tray 2.

The manual paper supply tray 2 includes a paper mounting unit 3 having a mounting surface 3 on which paper can be mounted, and movable auxiliary mounting units 4, 5 having two auxiliary mounting surfaces 4*a*, 5*a* that expand the mounting surface 3*a*. The auxiliary mounting units 4, 5 can be deployed in two steps from the paper mounting unit 3. In the present embodiment and the second to fifth embodiments described below, the manual paper supply tray 2 corresponds to the term "paper tray" in the claims, and the paper mounting unit 3 corresponds to the term "paper mounting unit" in the claims.

As shown in FIGS. 1(*b*) and (*c*), the paper mounting unit 3 can be deployed from and stored in a side surface 6*a* of a device body 6 by pivoting the paper mounting unit 3 around a pivot shaft (not shown in the figures) that is horizontally arranged on the side surface 6*a*. When pivoted downward and placed in the deployed state, the upper surface of the paper mounting unit 3 becomes the mounting surface 3*a* on which paper can be mounted. In addition, a recessed portion 6*b* sized in accordance with the outer shape of the paper mounting unit 3 is provided in the side surface 6*a* of the device body 6, and the paper mounting unit 3 is pivoted upward and stored inside the recessed portion 6*b*. Movable guide members 7 that serve to match the width of the paper supplied to the device body 6 are arranged on the mounting surface 3*a* of the paper mounting unit 3.

As shown in FIGS. 1(*a*), 1(*b*) and 2, the auxiliary mounting unit 4 is a first step first auxiliary mounting unit 4 that can be pulled out from the paper mounting unit 3 horizontal to the mounting surface 3*a*, and the auxiliary mounting unit 5 is a second step second auxiliary mounting unit 5 that can be pivoted around a pivot shaft 5*b* horizontally arranged near the edge of the first auxiliary mounting unit 4. A first auxiliary mounting surface 4*a* and a second auxiliary mounting surface 5*a* are the respective upper surfaces of first auxiliary mounting unit 4 and the second auxiliary mounting unit 5 in the deployed state, and serve to expand the mounting surface 3*a*. In addition, a recessed portion 4*b* sized in accordance with the outer shape of the second auxiliary mounting unit 5 is provided on the upper surface of the first auxiliary mounting unit 4, i.e., on the first auxiliary mounting surface 4*a*, and is configured so that the second auxiliary mounting unit 5 can be pivoted toward the paper mounting unit 3 and stored inside the recessed portion 4*b*. A cut-out 5*c* is provided in the edge portion of the second auxiliary mounting unit 5, and serves to allow a user to easily grasp and pivot the second auxiliary mounting unit 5 stored inside the recessed portion 4*b* to the deployed state. In addition, a recessed groove 4*c* whose planar shape is approximately the same as that of the cut-out 5*c* is provided inside the recessed portion 4*b* of the first auxiliary mounting surface 4*a* in order to allow a user to easily insert their finger in the cut-out 5*c*, and is positioned below the cut-out 5*c* when the second auxiliary mounting unit 5 is stored inside the recessed portion 4*b*.

As shown in FIG. 1(*b*), when the second auxiliary mounting unit 5 is stored in the recessed portion 4*b* of the first auxiliary mounting unit 4, the first auxiliary mounting unit 4 can be stored in the paper mounting unit 3. Thus, when the first auxiliary mounting unit 4 is stored in the paper mounting unit 3, i.e., when only the paper mounting unit 3 is in the deployed state (the state shown in FIG. 1(*b*)), a portion of the second auxiliary mounting unit 5 will visible on the mounting surface 3*a* and is hereinafter referred to as the visible portion 8. More specifically, the base area of the pivot shaft 5*b* that is on the lower surface of the second auxiliary mounting unit 5 when the same is deployed (the visible portion 8) is visible on the mounting surface 3*a* through a cut-out 3*b* in the paper mounting unit 3. The cut-out 3*b* of the paper mounting unit 3 is formed by cutting out a portion of the edge of the mounting surface 3*a*, and allows a user to easily grasp the first auxiliary mounting unit 4 and pull the same out from the paper mounting unit 3 when the first auxiliary mounting unit 4 is stored therein. In addition, the cut-out 3*b* allows the visible portion 8 to be visible on the mounting surface 3*a* of the paper mounting unit 3.

The brightness settings of the manual paper supply tray 2 and the side surface 6*a* of the device body 6 around the periphery thereof will now be described. Note that the brightness is in no way limited with regard to the degree of color vividness and hue, and may be set as desired.

The brightnesses of the paper mounting unit 3 (including the mounting surface 3*a*), the first auxiliary mounting unit 4 (including the first auxiliary mounting surface 4*a*), and the second auxiliary mounting unit 5 (including the second auxiliary mounting surface 5*a*) of the manual paper supply tray 2 are set to be lower than the brightness of the paper. In addition, the brightness of the second auxiliary mounting unit 5 (including the second auxiliary mounting surface 5*a*) is set to be higher than the brightness of the mounting surface 3*a* of the paper mounting unit 3. Thus, the brightness of the visible portion 8 of the second auxiliary mounting unit 5 is set to be higher than the brightness of the paper mounting unit 3. The brightness of the guide members 7 arranged on the mounting surface 3*a* of the paper mounting unit 3 is set to be higher than the brightness of the paper mounting unit 3. The brightnesses of the recessed portion 6*b* in which the paper mounting unit 3 is stored and the side surface 6*a* of the device body 6 around the periphery thereof are set to be lower than the brightness of the paper.

The brightnesses of the manual paper supply tray 2 and each portion of the device body 6 are ideally set such that the difference in brightness between the paper and the paper mounting unit 3 is 3 or greater and preferably 5 or greater, and the difference in brightness between the second auxiliary mounting unit 5 and the paper mounting unit 3 is 2 or greater and preferably 3 or greater. Because the brightness of standard paper is 9 to 9.5, these settings mean that the brightness of the paper mounting unit 3 is set to be 6 or less and preferably 4 or less, and the brightness of the second auxiliary mounting unit 5 is 2 or greater and preferably 3 or greater than the brightness of the paper mounting unit 3. Note that the brightness values of the present invention are values based upon the three color attributes display method defined in JIS Z8721. In the present embodiment, it will be assumed that the brightness of the paper mounting unit 3, the first auxiliary mounting unit 4, and the side surface 6*a* of the device unit 6 is 2, the brightness of the second auxiliary mounting unit 5 and the guide members 7 is 6, and the brightness of the other portions of the device body 6 is 8.

Thus, by making the brightnesses of the paper mounting unit 3 and the first auxiliary mounting unit 4 of the manual paper supply tray 2 sufficiently lower than the brightness of the paper, it will be easier to distinguish these portions of the manual paper supply tray 2 from the paper. In addition, by making the brightness of the side surface 6*a* of the mounting body 6 sufficiently lower than the brightness of the paper, it will be easier to confirm the thickness of the paper mounted on the manual paper supply tray 2. Thus, the presence or absence as well as the amount of paper mounted on the manual paper supply tray 2 can be confirmed by a user even if they are located some distance away from the image forming device 1. In addition, by making the brightness of the second auxiliary mounting unit 5 sufficiently higher than the brightness of the paper mounting unit 3, the brightness of the second auxiliary mounting unit 5 (i.e., the edge portion of the manual paper supply tray 2 when fully deployed) will be high, and thus the edge portion of the manual paper supply tray 2 will be easy to see, and thereby prevent people from colliding therewith even if the image forming device 1 is placed in a slightly dark location. Furthermore, when the first auxiliary mounting unit 4 and the second auxiliary mounting unit 5 are stored, the brightness of the visible portion 8 of the second auxiliary mounting unit 5 will be higher than the brightness of the paper mounting unit 3 around the periphery thereof. Furthermore, a regularity will be present in which both the visible portion 8 and the guide members 7 will have a high degree of brightness. Thus, a user will easily recognize the portion he or she must grasp (the visible portion 8) when the first auxiliary mounting unit 4 is to be pulled and deployed from the paper mounting unit 3, thereby allowing the user to easily deploy the manual paper supply tray 2.

In this first embodiment, as noted above, the respective members of the paper mounting unit 3 (including the mounting surface 3*a*), the first auxiliary mounting unit 4 (including the first auxiliary mounting surface 4*a*), and the second auxiliary mounting unit (including the second auxiliary mounting surface 5*a*) each have one brightness. However, if at least the mounting surface 3*a*, the first auxiliary mounting surface 4*a*, and the second auxiliary mounting surface 5*a*, or a portion of each of these mounting surfaces, e.g., the edge portion of the second auxiliary mounting surface 5*a*, the edge portion of the first auxiliary mounting surface 4*a*, and the like, have the aforementioned predetermined brightnesses, it will be possible to achieve the effects of the present invention, and the brightness of the other portions of the manual paper tray 2 will not pose a problem. However, even in that case, in order to make it easy for a user to deploy the manual paper tray 2, it is preferable for the visible portion 8 positioned on the lower surface of the second auxiliary mounting unit 5 when fully deployed to have the aforementioned predetermined brightness.

In addition, in this first embodiment, as noted above, the paper mounting unit 3 and the first auxiliary mounting unit 4 have the same brightness, and only the brightness of the second auxiliary mounting unit 5 is higher. However, the present invention is not limited to this brightness setting. The first auxiliary mounting unit 4 may have the same brightness as the second auxiliary mounting unit 5, and the brightness of the paper mounting unit 3 may be higher than this brightness. In addition, it is also possible for the brightness of the first auxiliary mounting unit 4 and the second auxiliary mounting unit 5 to increase stepwise from the paper mounting unit 3 toward the edge of the manual paper supply tray 2.

Second Embodiment

Figure 3:
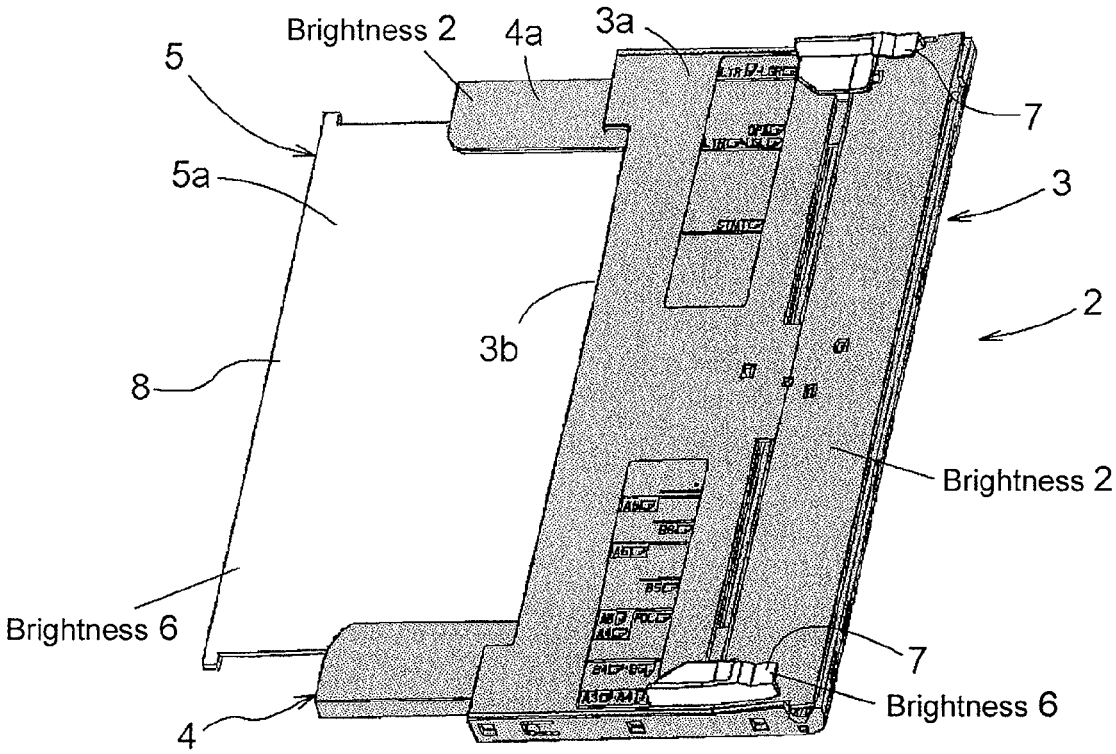
FIG. 3 shows an oblique view of a manual paper supply tray according to a second embodiment of the present invention.

FIG. 3 is an oblique view showing the configuration of a manual paper supply tray 2 of the image forming device 1 according to a second embodiment of the present invention. The configuration of the device body 6 is the same as that shown in FIG. 1. In each of the embodiments below, the same components as those in the first embodiment have the same reference numbers, and a description thereof will be omitted. Like the first embodiment, the manual paper supply tray 2 of the second embodiment includes a first auxiliary mounting unit 4 and a second auxiliary mounting unit 5 configured to be deployable in two steps from the paper mounting unit 3. However, the specific configuration of the first auxiliary mounting unit 4 and the second auxiliary mounting unit 5 in the second embodiment is different. In other words, in the present embodiment, the second auxiliary unit 5 is configured so as to be stored in the first auxiliary mounting unit 4, and is pulled out horizontally with the first auxiliary mounting surface 4*a* in order to be deployed. In addition, the first auxiliary mounting unit 4 is configured such that there is no central portion of the first auxiliary mounting surface 4*a*, and the second auxiliary mounting surface 5*a* of the second auxiliary mounting unit 5 stored in the first auxiliary mounting unit 4 is visible from the central portion of the first auxiliary mounting unit 4, both when the second auxiliary mounting unit 5 is deployed and when it is stored. Thus, when the second auxiliary mounting unit 5 is to be pulled from the first auxiliary mounting unit 4, a user can grasp the area around the edge portion of the second auxiliary mounting unit 5 (including the second auxiliary mounting surface 5*a*) and pull the second auxiliary mounting unit 5 out. In addition, when the first auxiliary mounting unit 4 and the second auxiliary unit 5 are both stored, and only the paper mounting unit 3 is extended and deployed with respect to the side surface 6*a* of the device body 6, the second auxiliary mounting surface 5*a* of the second auxiliary mounting unit 5 stored inside the paper mounting unit 3 will be visible from the cut-out 3*b* formed in the edge portion of the paper mounting unit 3, and form the visible portion 8.

The brightness settings of each portion of the manual paper supply tray 2 and the side surface 6*a* of the device body 6 around the periphery thereof are ideally set to be the same as those of the first embodiment. In this way, the same operational effects as those of the first embodiment can be obtained.

Third Embodiment

Figure 4:
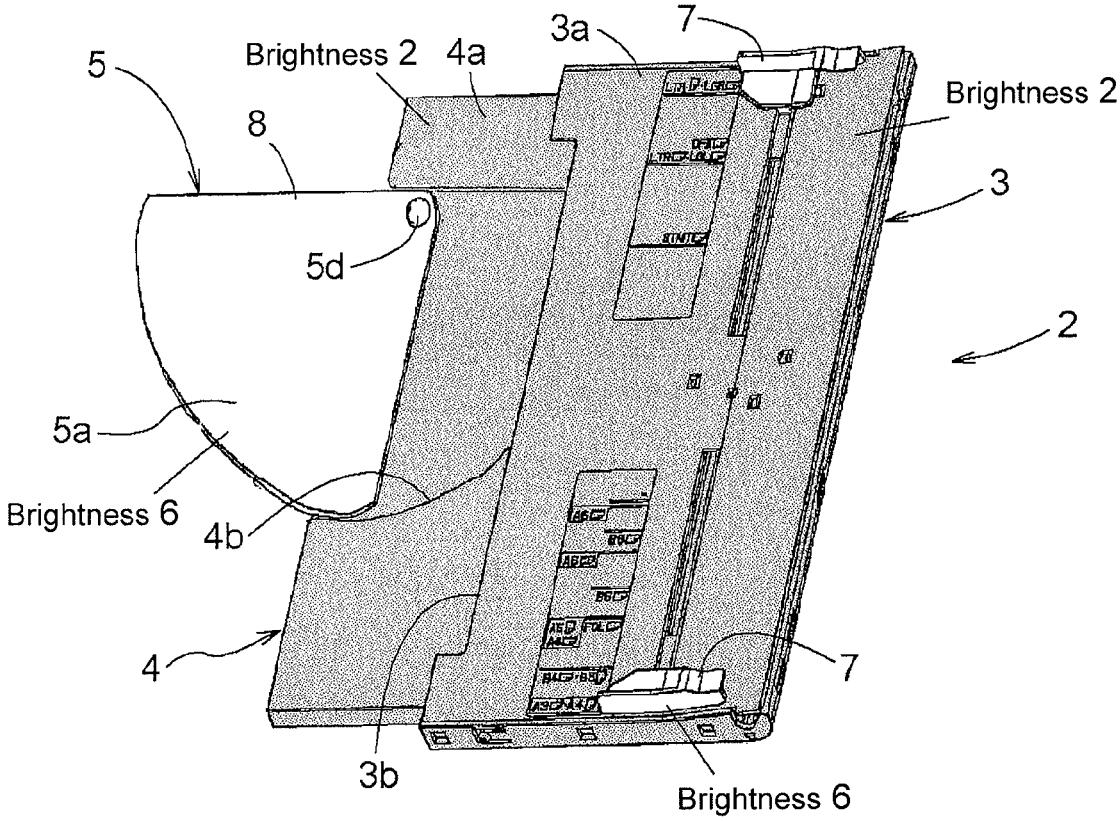
FIG. 4 shows an oblique view of a manual paper supply tray according to a third embodiment of the present invention.

FIG. 4 is an oblique view showing the configuration of a manual paper supply tray 2 of the image forming device 1 according to a third embodiment of the present invention. The configuration of the device body 6 is the same as that shown in FIG. 1. In each of the embodiments below, the same components as those in the first embodiment have the same reference numbers, and a description thereof will be omitted. Like the first embodiment, the manual paper supply tray 2 of the third embodiment includes a first auxiliary mounting unit 4 and a second auxiliary mounting unit 5 configured to be deployable in two steps from the paper mounting unit 3. However, the specific configuration of the second auxiliary mounting unit 5 in the third embodiment is different. In other words, in the third embodiment, the second auxiliary mounting unit 5 is arranged on top of the first auxiliary mounting surface 4*a* of the first auxiliary mounting unit 4, and can be deployed by pivoting around a rotational shaft 5*d* that is approximately perpendicular to the first auxiliary mounting surface 4*a* and the mounting surface 3*a* of the paper mounting unit 3. In addition, a fan-shaped recessed portion 4*b*, whose central point is the rotational shaft 5*d*, is formed on top of the first auxiliary mounting surface 4*a* of the first auxiliary mounting unit 4 in accordance with the rotational slide track of the second auxiliary mounting unit 5. The recessed portion 4*b* is configured such that the second auxiliary mounting surface 5*a* of the second auxiliary mounting unit 5 is visible on the first auxiliary mounting surface 4*a* even when the second auxiliary mounting unit 5 is stored. Thus, when the second auxiliary mounting unit 5 is to be pulled out from the first auxiliary mounting unit 4, it will be easy for a user to do so by grasping the second auxiliary mounting surface 5 and rotationally sliding the same. In addition, when the first auxiliary mounting unit 4 and the second auxiliary unit 5 are both stored, and only the paper mounting unit 3 is extended and deployed with respect to the side surface 6*a* of the device body 6, the second auxiliary mounting surface 5*a* of the second auxiliary mounting unit 5 stored inside the paper mounting unit 3 will be visible from the cut-out 3*b* formed in the edge of the paper mounting unit 3, and form the visible portion 8.

The brightness settings of each portion of the manual paper supply tray 2 and the side surface 6*a* of the device body 6 around the periphery thereof are ideally set to be the same as those of the first embodiment. In this way, the same operational effects as those of the first embodiment can be obtained.

Fourth Embodiment

Figure 5:
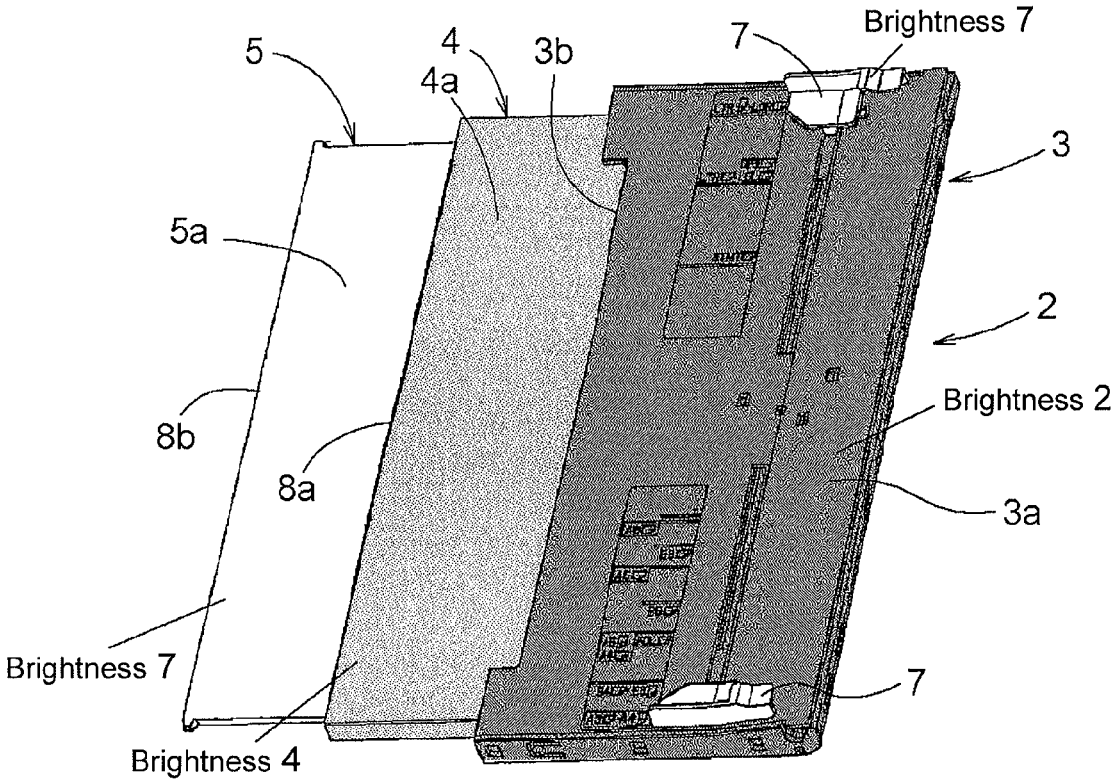
FIG. 5 shows an oblique view of a manual paper supply tray according to a fourth embodiment of the present invention.

FIG. 5 is an oblique view showing the configuration of a manual paper supply tray 4 of the image forming device 1 according to a fourth embodiment of the present invention. The configuration of the device body 6 is the same as that shown in FIG. 1. In each of the embodiments below, the same components as those in the first embodiment have the same reference numbers, and a description thereof will be omitted. Like the first embodiment, the manual paper supply tray 2 of the fourth embodiment includes a first auxiliary mounting unit 4 and a second auxiliary mounting unit 5 configured to be deployable in two steps from the paper mounting unit 3. However, the specific configuration of the first auxiliary mounting unit 4 and the second auxiliary mounting unit 5 in the fourth embodiment is different. In other words, in the present embodiment, the second auxiliary unit 5 is configured so as to be stored in the first auxiliary mounting unit 4, and is pulled out horizontally with the first auxiliary mounting surface 4*a* in order to be deployed. When stored, the edge of the second auxiliary mounting unit 5 will extend from the edge portion of the first auxiliary mounting unit 4, and form a second visible portion 8*b*. Thus, when the second auxiliary mounting unit 5 is to be pulled out from the first auxiliary unit 4, a user can grasp the second visible portion 8*b* of the second auxiliary mounting unit 5 and easily pull the second auxiliary mounting unit 5 out. In addition, when the first auxiliary mounting unit 4 and the second auxiliary mounting unit 5 are both stored, and only the paper mounting unit 3 is extended and deployed with respect to the side surface 6*a* of the device body 6, the first auxiliary mounting surface 4*a* of the first auxiliary mounting unit 4 stored inside the paper mounting unit 3 will be visible from the cut-out 3*b* formed in the edge of the paper mounting unit 3, and form a first visible portion 8*a*.

The brightness settings of the manual paper supply tray 2 and the side surface 6*a* of the device body 6 around the periphery thereof will now be described. Note that the brightness is in no way limited with regard to the degree of color vividness and hue, and may be set as desired.

The brightnesses of the paper mounting unit 3 (including the mounting surface 3*a*), the first auxiliary mounting unit 4 (including the first auxiliary mounting surface 4*a*), and the second auxiliary mounting unit 5 (including the second auxiliary mounting surface 5*a*) of the manual paper supply tray 2 are set to be lower than the brightness of the paper. In addition, the first auxiliary mounting unit 4 (including the first auxiliary mounting surface 4*a*) is set to a brightness that is higher than the brightness of the mounting surface 3*a* of the paper mounting unit 3, and the second auxiliary mounting unit 5 (including the second auxiliary mounting surface 5*a*) is set to a brightness that is higher than the brightness of the first auxiliary mounting surface 4*a*. In other words, in the present embodiment, the brightnesses of the paper mounting unit 3 (including the mounting surface 3*a*), the first auxiliary mounting unit 4 (including the first auxiliary mounting surface 4*a*), and the second auxiliary mounting unit 5 (including the second auxiliary mounting surface 5*a*) are set so as to become successively higher. Thus, the brightness of the first visible portion 8*a* of the first auxiliary mounting unit 4 is set to be higher than the brightness of the paper mounting unit 3. The brightness of the guide members 7 arranged on the mounting surface 3*a* of the paper mounting unit 3 is set to be higher than the brightness of the paper mounting unit 3. The brightness of the recessed portion 6*b* in which the paper mounting unit 3 is stored and the side surface 6*a* of the device body 6 around the periphery thereof is set to be lower than the brightness of the paper.

The brightness of each portion of the manual paper supply tray 2 is ideally set such that the difference in brightness between the paper and the paper mounting unit 3 is 3 or greater and preferably 5 or greater, the difference in brightness between the first auxiliary mounting unit 4 and the paper mounting unit 3 is 2 or greater and preferably 3 or greater, and the difference in brightness between the second auxiliary mounting unit 5 and the first auxiliary mounting unit 3 is 2 or greater and preferably 3 or greater. Because the brightness of standard paper is 9 to 9.5, these settings mean that the brightness of the paper mounting unit 3 is set to be 6 or less and preferably 4 or less, the difference in brightness between the first auxiliary mounting unit 4 and the paper mounting unit is 2 or greater and preferably 3 or greater, and the difference in brightness between the second auxiliary mounting unit 5 and the first auxiliary mounting unit 4 is 2 or greater and preferably 3 or greater. In the present embodiment, it will be assumed that the brightness of the paper mounting unit 3 and the side surface 6*a* of the device body 6 is 2, the brightness of the first auxiliary mounting unit 4 is 4, and the brightness of the second auxiliary mounting unit 5 and the guide members 7 is 7.

Thus, by making the brightnesses of the paper mounting unit 3 and the first auxiliary mounting unit 4 of the manual paper supply tray 2 sufficiently lower than the brightness of the paper, it will be easier to distinguish these portions of the manual paper supply tray 2 from the paper. In addition, by making the brightness of the side surface 6*a* of the mounting body 6 sufficiently lower than the brightness of the paper, it will be easier to confirm the thickness of the paper mounted on the manual paper supply tray 2 from the sides thereof. Thus, the present or absence as well as the amount of paper mounted on the manual paper supply tray 2 can be confirmed by a user even if they are located some distance away from the image forming device 1. In addition, by making the brightnesses of the paper mounting unit 3 (including the mounting surface 3*a*), the first auxiliary mounting unit 4 (including the first auxiliary mounting surface 4*a*), and the second auxiliary mounting unit 5 (including the second auxiliary mounting surface 5*a*) increase in this sequence, and making the highest brightness that of the second auxiliary mounting unit 5 (which is furthest away from the paper mounting unit 3), the edge portion of the manual paper supply tray 2 will be easy to see when fully deployed, and thereby prevent people from colliding there with even if the image forming device 1 is placed in a slightly dark location. Furthermore, when the first auxiliary mounting unit 4 and the second auxiliary mounting unit 5 are stored, a regularity will be present in which the brightnesses of the first visible portion 8*a* of the first auxiliary mounting unit 4 and the second visible portion 8*b* of the second auxiliary mounting unit 5 will be higher than the brightness of the paper mounting unit 3 around the periphery thereof. Furthermore, the moving parts including the guide members 7 will have a high degree of brightness. Thus, a user will easily recognize the portion he or she must grasp (the first visible portion 8*a* or the second visible portion 8*b*) when the first auxiliary mounting unit 4 is to be pulled and deployed from the paper mounting unit 3, or the second auxiliary mounting unit 5 is to be pulled and deployed from the first auxiliary mounting unit 4, thereby allowing the user to easily deploy the manual paper supply tray 2.

In this fourth embodiment, as noted above, the respective members of the paper mounting unit 3 (including the mounting surface 3*a*), the first auxiliary mounting unit 4 (including the first auxiliary mounting surface 4*a*), and the second auxiliary mounting unit (including the second auxiliary mounting surface 5*a*) each have one brightness. However, if at least the mounting surface 3*a*, the first auxiliary mounting surface 4*a*, and the second auxiliary mounting surface 5*a*, or a portion of each of these mounting surfaces, e.g., the edge of the second auxiliary mounting surface 5*a*, the edge of the first auxiliary mounting surface 4*a*, and the like, have the aforementioned predetermined brightnesses, it will be possible to achieve the effects of the present invention, and the brightnesses of the other portions of the manual paper supply tray 2 will not pose a problem.

Fifth Embodiment

Figure 6:
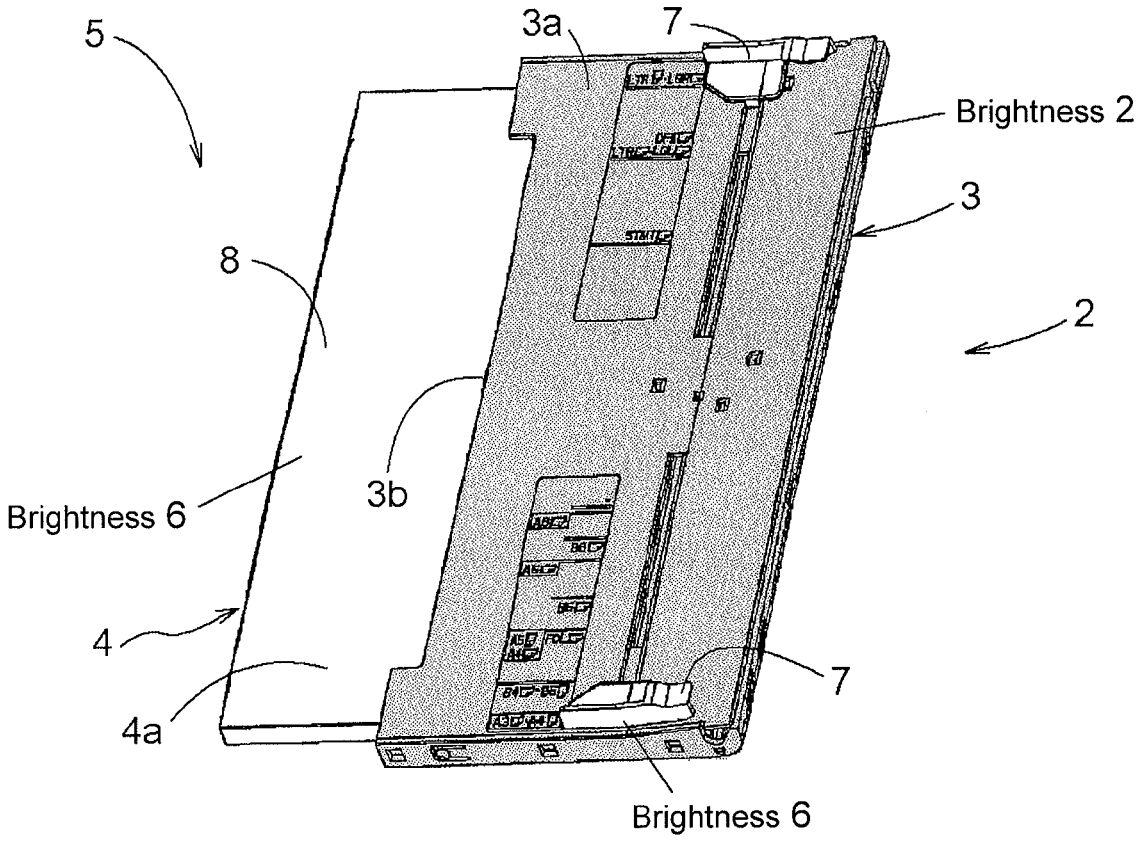
FIG. 6 shows an oblique view of a manual paper supply tray according to a fifth embodiment of the present invention.

FIG. 6 is an oblique view showing the configuration of a manual paper supply tray 5 of the image forming device 1 according to a fifth embodiment of the present invention. The configuration of the device body 6 is the same as that shown in FIG. 1. In each of the embodiments below, the same components as those in the first embodiment have the same reference numbers, and a description thereof will be omitted. The present embodiment differs from the first embodiment in that the manual paper supply tray 2 only has a first auxiliary mounting unit 4 which can only be deployed in one step from the paper mounting unit 3, and does not have a second auxiliary mounting unit 5. In the present embodiment, when the first auxiliary mounting unit 4 is stored, and only the paper mounting unit 3 is extended and deployed with respect to the side surface 6*a* of the device body 6, the first auxiliary mounting surface 4*a* of the first auxiliary mounting unit 4 stored inside the paper mounting unit 3 will be visible from the cut-out 3*b* formed in the edge of the paper mounting unit 3, and form the visible portion 8.

The brightness settings of the manual paper supply tray 2 and the side surface 6*a* of the device body 6 around the periphery thereof will now be described. Note that the brightness is in no way limited with regard to the degree of color vividness and hue, and may be set as desired.

The brightness of the paper mounting unit 3 (including the mounting surface 3*a*) and the first auxiliary mounting unit 4 (including the first auxiliary mounting surface 4*a*) is set to be lower than the brightness of the paper. In addition, the brightness of the first auxiliary mounting unit 4 (including the first auxiliary mounting surface 4*a*) is set to be higher than the brightness of the mounting surface 3*a* of the paper mounting unit 3. Thus, the brightness of the visible portion 8 of the first auxiliary mounting unit 4 is also set to be higher than the brightness of the paper mounting unit 3. The brightness of the guide members 7 arranged on the mounting surface 3*a* of the paper mounting unit 3 is set to be higher than the brightness of the paper mounting unit 3. The brightnesses of the recessed portion 6*b* in which the paper mounting unit 3 is stored and the side surface 6*a* of the device body 6 around the periphery thereof are set to be lower than the brightness of the paper.

The brightness of each portion of the manual paper supply tray 2 is ideally set such that the difference in brightness between the paper and the paper mounting unit 3 is 3 or greater and preferably 5 or greater, and the difference in brightness between the first auxiliary mounting unit 4 and the paper mounting unit 3 is 2 or greater and preferably 3 or greater. Because the brightness of standard paper is 9 to 9.5, these settings mean that the brightness of the paper mounting unit 3 is set to be 6 or less and preferably 4 or less, and the difference in brightness between the first auxiliary mounting unit 4 and the paper mounting unit 3 is 2 or greater and preferably 3 or greater. In the present embodiment, it will be assumed that the brightness of the paper mounting unit 3 and the side surface 6*a* of the device body 6 is 2, the brightness of the first auxiliary mounting unit 4 is 4 and the guide members 7 is 6.

Thus, by making the brightnesses of the paper mounting unit 3 and the first auxiliary mounting unit 4 of the manual paper supply tray 2 sufficiently lower than the brightness of the paper, it will be easier to distinguish these portions of the manual paper supply tray 2 from the paper. In addition, by making the brightness of the side surface 6*a* of the mounting body 6 sufficiently lower than the brightness of the paper, it will be easier to confirm the thickness of the paper mounted on the manual paper supply tray 2. Thus, the present or absence as well as the amount of paper mounted on the manual paper supply tray 2 can be confirmed by a user even if they are located some distance away from the image forming device 1. In addition, by making the brightness of the first auxiliary mounting unit 4 sufficiently higher than the brightness of the paper mounting unit 3, the brightness of the first auxiliary mounting unit 4 (i.e., the edge of the manual paper supply tray 2 when fully deployed) will be high, and thus the edge of the manual paper supply tray 2 will be easy to see, and thereby prevent people from colliding therewith even if the image forming device 1 is placed in a slightly dark location. Furthermore, when the first auxiliary mounting unit 4 is stored, the brightness of the visible portion 8 of the first auxiliary mounting unit 4 will be higher than the brightness of the paper mounting unit 3 around the periphery thereof. Furthermore, a regularity will be present in which the moving portions including the guide members 7 will have a high degree of brightness. Thus, a user will easily recognize the portion he or she must grasp (the visible portion 8) when the first auxiliary mounting unit 4 is to be pulled and deployed from the paper mounting unit 3, thereby allowing the user to easily deploy the manual paper supply tray 2.

In the fifth embodiment, as noted above, the respective members of the paper mounting unit 3 (including the mounting surface 3*a*) and the first auxiliary mounting unit 4 (including the first auxiliary mounting surface 4*a*) each have one brightness. However, if at least the mounting surface 3*a* and the first auxiliary mounting surface 4*a*, or a portion of each of these mounting surfaces, e.g., the edge of the first auxiliary mounting surface 4*a* and the like, have the aforementioned predetermined brightness, it will be possible to achieve the effects of the present invention, and the brightness of the other portions of the manual paper tray 2 will not pose a problem.

Sixth Embodiment

Figure 7:
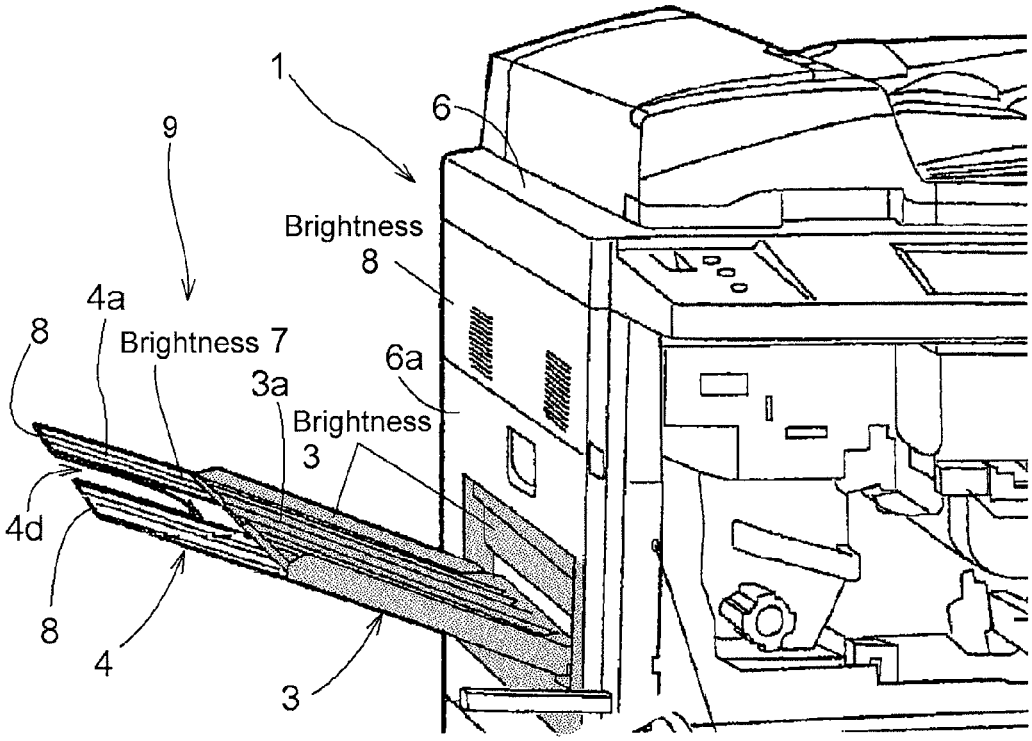
FIG. 7 shows an oblique view of a paper discharge tray of an image forming device according to a sixth embodiment of the present invention.

FIG. 7 is an oblique view showing the configuration of a paper discharge tray 9 of the image forming device 1 in the deployed state according to a sixth embodiment of the present invention. The paper discharge tray 9 includes a paper mounting unit 3 having a mounting surface 3 arranged thereon on which printed sheets can be mounted, and a movable auxiliary mounting unit 4 having an auxiliary mounting surface 4*a* arranged thereon that extends the mounting surface 3*a* and is deployable in one step from the paper mounting unit 3. In the present embodiment, the paper discharge tray 9 corresponds to the term "paper tray" in the claims, the printed sheets correspond to the term "paper" in the claims, and the paper mounting unit 3 corresponds to the term "paper mounting unit" in the claims.

As shown in FIG. 7, the paper mounting unit 3 extends out from the side surface 6*a* of the device body 6, and the upper surface of the paper mounting unit 3 is the mounting surface 3*a* on which paper can be mounted. In addition, the auxiliary mounting unit 4 is configured to expand the mounting surface 3*a* when pulled out from the paper mounting unit 3 horizontal with the mounting surface 3*a*. The upper surface of the auxiliary mounting unit 4 in the deployed state is the auxiliary mounting surface 4*a*. A cut-out 4*d* is provided in the edge of the auxiliary mounting unit 4 in order to make it easier for a user to grasp paper mounted on the mounting surface 3*a* and the auxiliary mounting surface 4*a*. When the auxiliary mounting unit 4 is slid toward the right in FIG. 7 along the mounting surface 3*a* and stored in the paper mounting unit 3, the edge of the auxiliary mounting unit 4 will slightly extend out from the edge of the paper mounting unit 3, and form an visible portion 8 that is visible on the mounting surface 3*a*.

The brightness settings of the paper discharge tray 9 and the side surface 6*a* of the device body 6 around the periphery thereof will now be described. Note that the brightness is in no way limited with regard to the degree of color vividness and hue, and may be set as desired.

The brightnesses of the paper mounting unit 3 (including the mounting surface 3*a*) and the auxiliary mounting unit 4 (including the auxiliary mounting surface 4*a*) are set to be lower than the brightness of the paper. In addition, the brightness of the auxiliary mounting unit 4 (including the auxiliary mounting surface 4*a*) is set to be higher than the brightness of the mounting surface 3*a* of the paper mounting unit 3. Thus, the brightness of the visible portion 8 of the auxiliary mounting unit 4 is also set to be higher than the brightness of the paper mounting unit 3. The brightness of the side surface 6*a* of the device body 6 is set to a brightness that is lower than the brightness of the paper.

The brightnesses of the paper discharge tray 9 and each portion of the device body 6 are ideally set such that the difference in brightness between the paper and the paper mounting unit 3 is 3 or greater and preferably 5 or greater, and the difference in brightness between the auxiliary mounting unit 4 and the paper mounting unit 3 is 2 or greater and preferably 3 or greater. In addition, because the brightness of standard paper is 9 to 9.5, these settings mean that the brightness of the paper mounting unit 3 is set to be 6 or less and preferably 4 or less, and the brightness of the auxiliary mounting unit 4 is 2 or greater and preferably 3 or greater than the brightness of the paper mounting unit 3. In the present embodiment, it will be assumed that the brightness of the paper mounting unit 3 and the side surface 6*a* of the device unit 6 is 3, the brightness of the auxiliary mounting unit 4 is 7, and the brightness of the other portions of the device body 6 is 8.

Thus, by making the brightness of the paper mounting unit 3 of the paper discharge tray 9 sufficiently lower than the brightness of the paper, it will be easier to distinguish the paper mounting unit 3 of the paper discharge tray 9 from the paper. In addition, by making the brightness of the side surface 6*a* of the mounting body 6 sufficiently lower than the brightness of the paper, it will be easier to confirm the thickness of the paper mounted on the paper discharge tray 9. Thus, even if a user is located some distance away from the image forming device 1, they can confirm whether or not paper is being discharged to the paper discharge tray 9, i.e., whether or not the image forming device 1 is operating, and can confirm the amount of printed sheets that have been discharged. In addition, by making the brightness of the auxiliary mounting unit 4 sufficiently higher than the brightness of the paper mounting unit 3, the brightness of the auxiliary mounting unit 4 (i.e., the edge of the paper discharge tray 9 when fully deployed) will be high, and thus the edge of the paper discharge tray 9 will be easy to see, and thereby prevent people from colliding therewith even if the image forming device 1 is placed in a slightly dark location. Furthermore, when the auxiliary mounting unit 4 is in the stored state, the brightness of the visible portion 8 of the auxiliary mounting unit 4 will be higher than the brightness of the paper mounting unit 3 around the periphery thereof, and thus a user will easily recognize the portion they must grasp (the visible portion 8) when the auxiliary mounting unit 4 is to be pulled and deployed from the paper mounting unit 3, thereby allowing the user to easily deploy the paper discharge tray 9.

In the sixth embodiment, as noted above, the respective members of the paper mounting unit 3 (including the mounting surface 3*a*) and the auxiliary mounting unit 4 (including the auxiliary mounting surface 4*a*) each have one brightness. However, if at least the mounting surface 3*a* and the auxiliary mounting surface 4*a*, or a portion of each of these mounting surfaces, e.g., the edge of the auxiliary mounting surface 4*a* and the like, have the aforementioned predetermined brightness, it will be possible to achieve the effects of the present invention, and the brightness of the other portions of the paper discharge tray 9 will not pose a problem.

Seventh Embodiment

Figure 8:
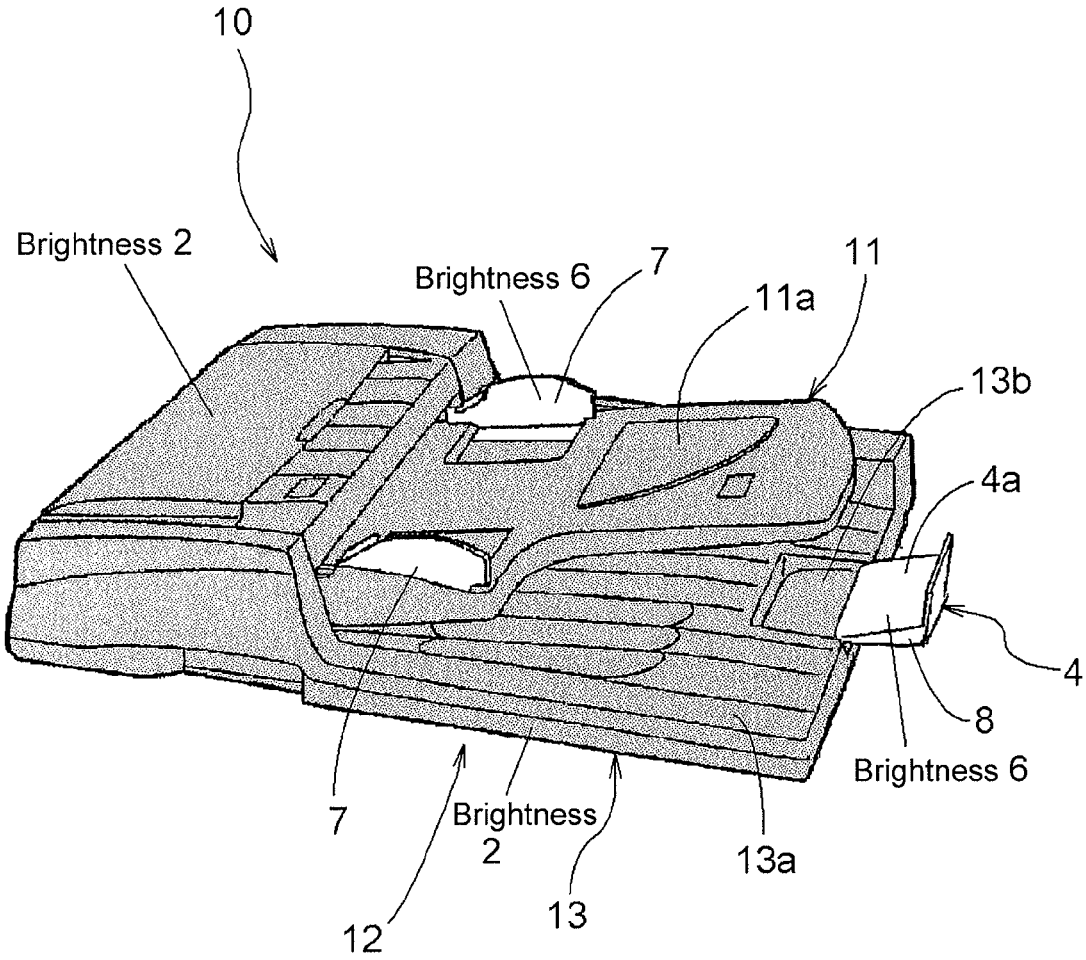
FIG. 8 shows an oblique view of an original document transport device of an image forming device according to a seventh embodiment of the present invention.

FIG. 8 is an oblique view showing the configuration of an original document transport device 10 of the image forming device 1 according to a seventh embodiment of the present invention. The original document transport device 10 includes an original document mounting tray 11 in which a user will mount original documents before being read by an original document reading unit (not shown in the figures), and a discharge tray 12 to which the original documents are discharged after being read. Movable guide members 7 that serve to match the width of the original documents supplied to the original document reading unit are arranged on a mounting surface 11*a* of the original document mounting tray 11. In addition, the paper discharge tray 12 includes an original document discharge unit 13 having a mounting surface 13 arranged thereon on which original documents are discharged and mounted after being read, and a movable auxiliary mounting unit 4 having an auxiliary mounting surface 4*a* arranged thereon that extends the mounting surface 13*a* and is deployable in one step from the original document discharge unit 13. In the present embodiment, the paper discharge tray 12 corresponds to the term "paper tray" in the claims, the original documents correspond to the term "paper" in the claims, and the original document discharge unit 13 corresponds to the term "paper mounting unit" in the claims.

As shown in FIG. 8, the auxiliary mounting unit 4 can be deployed by pivoting around a pivot shaft (not shown in the figures) that is arranged to be horizontal with the edge of the original document discharge unit 13, and the upper surface of the auxiliary mounting unit 4 when deployed is the auxiliary mounting surface 4*a*. In addition, a recessed portion 13*b* sized in accordance with the outer shape of the auxiliary mounting unit 4 is provided in the upper surface of the original document discharge unit 13, i.e., the mounting surface 13*c*, and the auxiliary mounting unit 4 is configured so as to be pivoted and stored inside the recessed portion 13*b*. When the auxiliary mounting unit 4 is stored in the original document discharge unit 13, a portion of the auxiliary mounting unit 4, i.e., the upper surface of the auxiliary mounting unit 3 when stored (the lower surface thereof when deployed), will be a visible portion 8 that is visible on the mounting surface 13*a* of the original document discharge unit 13.

The brightness settings of the original document transport device 10 according to the present embodiment will now be described. Note that the brightness is in no way limited with regard to the degree of color vividness and hue, and may be set as desired.

The brightnesses of the original document discharge unit 13 (including the mounting surface 13*a*), the auxiliary mounting unit 4 (including the auxiliary mounting surface 4*a*), and the original document mounting tray 11 of the original document transport device 10 are set to be lower than the brightness of the paper. In addition, the brightness of the auxiliary mounting unit 4 (including the auxiliary mounting surface 4*a*) is set to be higher than the brightness of the mounting surface 13*a* of the original document discharge unit 13. Thus, the brightness of the visible portion 8 of the auxiliary mounting unit 4 is set to be higher than the brightness of the original document discharge unit 13. The brightness of the guide members 7 arranged on top of the original document mounting tray 11 is set to be higher than the brightness of the original document mounting tray 11 and the original document discharge unit 13.

The brightnesses of the original document transport device 10 are ideally set such that the difference in brightness between the original documents and the original document discharge unit 13 is 3 or greater and preferably 5 or greater, and the difference in brightness between the auxiliary mounting unit 4 and the original document discharge unit 13 is 2 or greater and preferably 3 or greater. In addition, because the brightness of standard paper is 9 to 9.5, these settings mean that the brightness of the original document discharge unit 13 is set to be 6 or less and preferably 4 or less, and the brightness of the auxiliary mounting unit 4 is 2 or greater and preferably 3 or greater than the brightness of the original document discharge unit 13. In the present embodiment, it will be assumed that the brightness of the original document discharge unit 13 and the original document mounting tray 11 is 2, the brightness of the auxiliary mounting unit 4 and the guide members 7 is 6, and the brightness of the other portions of the original document transport device 10 is 2.

Thus, by making the brightness of the original document discharge unit 13 and the original document mounting tray 11 of the original document transport device 10 sufficiently lower than the brightness of the paper, it will be easier to distinguish the original document discharge unit 13 and the original document mounting tray 11 from the paper. Thus, even if a user is located some distance away from the image forming device 1, they can confirm whether or not original documents are being discharged to the original document discharge tray 13, i.e., whether or not the original document transport device 10 is operating, and can confirm the amount of original documents remaining on the original document mounting tray 11. In addition, when the auxiliary mounting unit 4 is stored, the brightness of the visible portion 8 of the auxiliary mounting unit 4 will be higher than the brightness of the original document discharge unit 13 around the periphery thereof. Furthermore, a regularity will be present in which the moving portions including the guide members 7 will have a high degree of brightness. Thus, a user will easily recognize the portion he or she must grasp (the visible portion 8) when the auxiliary mounting unit 4 is to be pulled and deployed from the original document discharge unit 13, thereby allowing the user to easily deploy the paper discharge tray 4.

In the seventh embodiment, as noted above, the respective members of the original document discharge unit 13 (including the mounting surface 13*a*) and the auxiliary mounting unit 4 (including the auxiliary mounting surface 4*a*) each have one brightness. However, if at least the mounting surface 13*a* and the auxiliary mounting surface 4*a*, or a portion of each of these mounting surfaces, e.g., the edge of the auxiliary mounting surface 4*a* and the like, have the aforementioned predetermined brightness, it will be possible to achieve the effects of the present invention, and the brightness of the other portions of the original document transport device 10 will not pose a problem.

Experiment to Confirm the Effects of the Invention

An experiment was performed in order to confirm what type of effects would be observed due to the brightness settings of various portions of the paper tray and device body of the image forming device 1 according to the present invention, and the results of this experiment are described below. FIG. 9 is a table showing the results of this experiment. The present experiment used the paper discharge tray 9 of the image forming device 1 according to the sixth embodiment, and a plurality of subjects were asked whether or not they were able to recognize whether or not the auxiliary mounting unit is deployed, the presence or absence of discharged paper, and whether or not paper is being discharge, when the brightnesses of each portion of the paper mounting unit 3, the auxiliary mounting unit 4, and the side surface 6*a* of the device unit were modified. The specific details of how the experiment was conducted are provided below.

An image forming device 1 was placed in a corner of a slightly dark room having an illumination intensity of 10 lux, and was 10 meters away from a subject's desk illuminated at an intensity of 550 lux. Subject A was a 25 year old female having a visual acuity of 1.2, and subject B was a 53 year old male having a visual acuity of 0.5 (nearsighted). The paper discharged to the discharge tray 9 was either A3 or A4 size and had a brightness of 9. Then, paper sheets having the predetermined brightnesses shown in FIG. 9 were attached to each portion of the paper mounting unit 3, the auxiliary mounting unit 4, and the side surface 6*a* of the device body, 100 sheets of paper were discharged for each subject, and a determination was performed by calculating the recognition rate of following three items: (1) whether or not the subject could recognize whether the auxiliary mounting unit 4 was deployed or stored (ability to recognize the auxiliary mounting unit deployment state), (2) whether or not the subject could recognize the presence or absence of discharged paper on the paper mounting unit 3 and the auxiliary mounting unit 4 (ability to recognize presence or absence of discharged paper), and (3) whether or not the subject could recognize that paper is being discharged on the paper mounting unit 3 and the auxiliary mounting unit 4 (ability to recognize continuous paper discharge). The results of this determination are indicated with "+" when the recognition ratio was 95% or greater, "±" when the recognition ratio was between 70% and 94%, and "−" when the recognition ratio was less than 70%.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. An image forming device, comprising:

an image forming device body having an image forming unit in the interior thereof; and a document transport device being attached to the image forming device and being configured to have paper mounted thereon, the document transport device having an original document mounting tray being configured to have original documents mounted thereon and having a mounting surface, movable guide members being configured to match the width of the paper mounted on the mounting surface, and a discharge tray being configured to receive discharged original documents, the discharge tray having an original document discharge unit having an original document discharge mounting surface, and a movable auxiliary mounting unit having an auxiliary mounting surface arranged thereon to extend the original document discharge mounting surface, brightnesses of the original document discharge unit, auxiliary mounting unit, and original document mounting tray being lower than a brightness of the paper to be mounted on the mounting surface of the original document mounting tray, and the brightness of the auxiliary mounting unit and movable guide members being higher than the brightness of other components to which the auxiliary mounting unit and the movable guide members being attached.

2. The image forming device set forth in claim 1, wherein the difference between the brightness of the paper and the brightness of the mounting surface of the original document mounting tray is 3 or greater as defined by JIS Z8721, and the difference between the brightness of the auxiliary mounting surface and the brightness of the mounting surface of the original document mounting tray is 2 or greater as defined by JIS Z8721.

3. The image forming device set forth in claim 1, wherein the brightness of the mounting surface of the original document mounting tray is 6 or less as defined by JIS Z8721, and the difference between the brightness of the portion of the auxiliary mounting surface and the brightness of the mounting surface of the original document mounting tray is 2 or greater as defined by JIS Z8721.

* * * * *